US006523795B2

(12) United States Patent
Gutgsell et al.

(10) Patent No.: US 6,523,795 B2
(45) **Date of Patent: *Feb. 25, 2003**

(54) TABLE LEG WIRE MANAGEMENT APPARATUS

(75) Inventors: David R. Gutgsell; Scott Schwinghammer, both of Jasper, IN (US)

(73) Assignee: Ditto Sales, Inc., Jasper, IN (US)

( * ) Notice: Subject to any disclaimer, the term of this patent is extended or adjusted under 35 U.S.C. 154(b) by 8 days.

This patent is subject to a terminal disclaimer.

(21) Appl. No.: 09/887,200

(22) Filed: Jun. 22, 2001

(65) Prior Publication Data

US 2001/0032913 A1 Oct. 25, 2001

Related U.S. Application Data

(63) Continuation of application No. 09/071,870, filed on May 1, 1998.

(51) Int. Cl.[7] ..... F16M 11/20; A47B 37/00; A47B 17/00

(52) U.S. Cl. ..... 248/188.1; 108/50.02; 108/150; 312/223.3

(58) Field of Search ..... 248/188.1, 49, 248/51, 918, 345.1; 108/50.01, 23, 147.21, 50.02, 150; 312/223.6, 223.3; 174/101, 95, 97, 48, 49

(56) References Cited

U.S. PATENT DOCUMENTS

| | | | | |
|---|---|---|---|---|
| 3,635,174 A | * | 1/1972 | Ball et al. | 108/150 |
| 3,881,520 A | | 5/1975 | Murphy | |
| 4,017,137 A | | 4/1977 | Parks | |
| 4,377,724 A | | 3/1983 | Wilson | |
| 4,463,057 A | * | 7/1984 | Knurr | 428/595 |
| 4,762,072 A | | 8/1988 | Boundy et al. | |
| 4,874,322 A | | 10/1989 | Dola et al. | |
| 4,918,886 A | | 4/1990 | Benoit et al. | |
| 5,154,126 A | * | 10/1992 | Newhouse et al. | 108/50 |
| 5,237,935 A | * | 8/1993 | Newhouse et al. | 108/50 |
| 5,357,874 A | * | 10/1994 | Palmer | 108/50 |
| 5,638,759 A | * | 6/1997 | Klugkist | 108/50 |
| 5,715,761 A | * | 2/1998 | Frattini | 108/50 |
| 5,852,981 A | * | 12/1998 | Henderson | 108/158 |
| 6,086,028 A | * | 7/2000 | Pfister | 248/188.8 |

FOREIGN PATENT DOCUMENTS

GB 2139488 11/1984

OTHER PUBLICATIONS

European Patent Document No. EP 0 010 277 A1, "Seitengestell für Büromöbel," Oct. 15, 1979.
European Patent Document No. EP 0 563 850 A1, "Arbeitsplatz," Mar. 29, 1993.
Search Report, GB Patent Application 9909791.7.

* cited by examiner

*Primary Examiner*—Anita King
(74) *Attorney, Agent, or Firm*—Leagre Chandler & Millard LLP

(57) ABSTRACT

A furniture leg wire management apparatus is configured for use with a furniture leg formed by opposite leg posts separated by a gap. The apparatus includes a legway defined by an elongated tubular body. The body includes a forward portion and opposite clamping arms that are resiliently deflectable toward each other. The clamping arms are deflected when the legway is pushed into the gap between the leg posts and provide an outwardly directed force to clamp the legway in this operative position. The tubular body further includes a central rib terminated in a rear flange. The central rib divides the legway into two wire/cable channels, while the rear flange cooperates with the clamping arms to define opposite elongated slots. The slots communicate with the two cable channels to provide an avenue to feed the wires/cables into a corresponding channel. The wire management apparatus further includes a decorative cover plate that is removably mounted on the legway to improve its aesthetics.

21 Claims, 4 Drawing Sheets

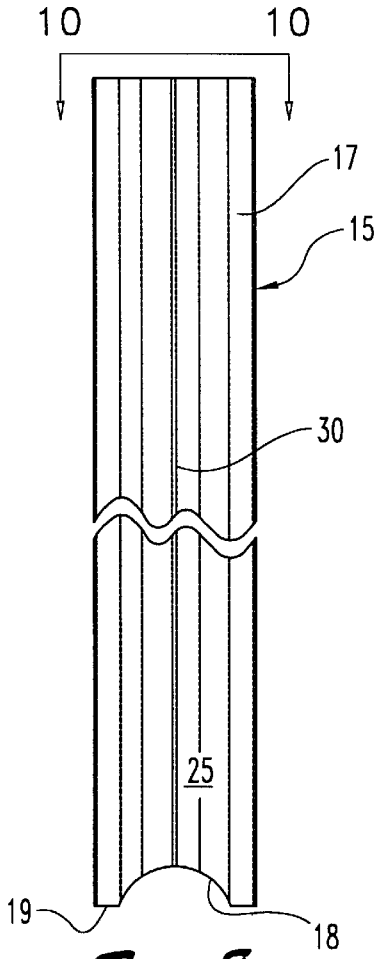
Fig. 8
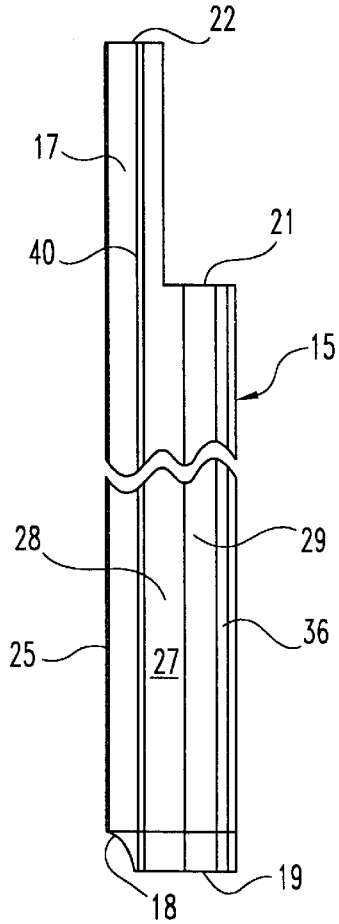
Fig. 9
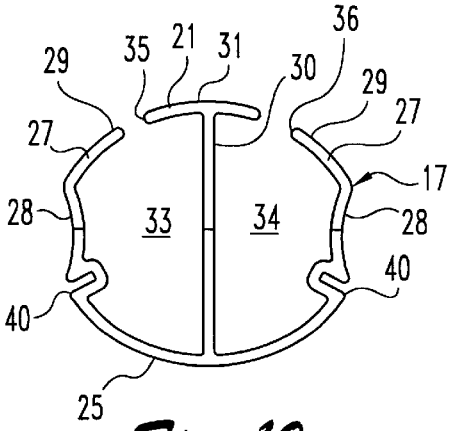
Fig. 10
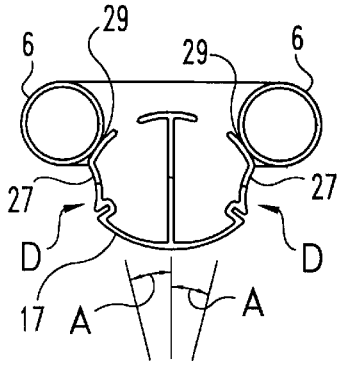
Fig. 11
Fig. 12
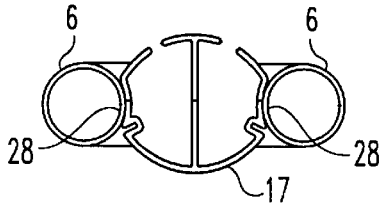

TABLE LEG WIRE MANAGEMENT APPARATUS

The present patent application is a continuation of co-pending U.S. patent application Ser. No. 09/071,870 filed May 1, 1998.

BACKGROUND OF THE INVENTION

The present invention relates to wire management systems for furniture, particular office furniture, such as conference/training tables or workstations. More specifically, the invention concerns a wire management apparatus incorporated into a leg of the office furniture.

The plethora of electrical equipment used in most office environments presents a nettlesome problem, namely the problem of managing the seemingly endless array of electrical wires and data cables associated with the equipment. For example, a typical workstation personal computer will include power cables for the computer, printer and monitor, data cables between each of these components, networking cables, phone lines, and even wires associated with audio components of more sophisticated work stations. This problem is compounded where multiple workstations are involved, such as in a conference or training facility. Many such facilities utilize a number of large tables having multiple workstations. In these circumstances, the number of wires and cables that must be managed can be daunting.

Many articles of business furniture incorporate bezels formed in the working surface of the furniture through which the wires and cables pass. These bezels help clear the working surface of electrical wiring, but do little to solve the overall wire management problem. Many multiple workstation tables incorporate wire management features that channel the wires and cables through raceways attached to the table. While these raceways go a step further in clearing the working area of loose wires, these components still leave the problem of carrying the wires to wall outlets to power up the workstation electronics. The raceway suffers from the detriment common to the furniture wire bezel in which the wires still dangle from the furniture on their path to the wall outlet. These dangling wires and cables pose a risk that a workstation operator will unwittingly become tangled in the wiring. Moreover, the exposed wiring is generally aesthetically displeasing.

Consequently, there remains a need in the field of wire management for a system to virtually eliminate all dangling and exposed wires and cables. The optimum goal is to provide a system that emulates a fully hidden hard-wired approach in the arena of movable and/or stowable furniture.

SUMMARY OF THE INVENTION

In order to achieve this optimum goal, the present invention contemplates a furniture leg that is an integral component in the wire management protocol. In one; aspect of the invention, the table leg includes a pair of leg posts separated. by a gap but joined at the bottom of each post to feet configured for supporting the leg on the floor. A tubular legway is resiliently mounted within the gap or channel between the leg posts. The legway defines an entry opening or notch at the upper end of the legway immediately adjacent the underside of the working surface of the article of furniture. An exit opening is formed at the bottom end of the legway adjacent the feet. The tubular legway is sized to house a plurality of electrical wires and data cables with the wires passing through the upper entry notch and out the lower exit opening.

In one feature of the legway, the tubular body includes opposite clamping arm s that form arcuate recesses. The clamping arms are joined at a forward portion so that the legs are resiliently deflectable toward each other. In the natural or unstressed configuration of the legway, the clamping arms are splayed apart. The legway can be pressed into the gap or channel between the leg posts by deflecting the clamping arms toward each other. With the legway fully disposed in the gap, the leg posts reside within the recess defined in the clamping arms, and the clamping arms exert an outward restorative force to maintain the legway in that operative position.

In a further aspect of the invention, the tubular body of the legway includes a central rib extending along the length of the legway. The central rib stiffens the elongated legway and divides the legway into two wire channels. The central rib preferably includes a rear flange that cooperates with each of the clamping arms to define wire entry slots extending along the length of the legway. The wire entry slots are sized to allow passage of electrical/data wires and cables into the wire channels. This feature eliminates the need to guide the plug or connector end of the wire/cable through the length of the legway and out the lower exit opening. On the other hand, the wire entry slots are narrow enough to reduce the likelihood that any wire or cable will slide out of the legway.

Yet another feature of the furniture leg wire management apparatus of the present invention is a cover plate mounted on the tubular legway. In the preferred embodiment, the cover plate is decorative, so that the legway itself can be formed of a plain, aesthetically neutral material. The cover plate can be in the form of an elongated arcuate sheet of material with inwardly directed tangs at the free edges of the sheet. The tangs fit into corresponding slots defined in the tubular body of the legway.

It is one object of the invention to provide a further link in the chain of wire management for electrified furniture. One specific object is to provide means to conceal and manage wires and cables that would otherwise hang from the working surface of the furniture.

Another object of the present invention is realized in certain features that allow the wire management apparatus to be readily removed for modification or storage. A further object is to provide a furniture leg-based wire management apparatus that is aesthetically pleasing.

These objects and certain benefits of the invention can be discerned from the Following written description and accompanying figures.

DESCRIPTION OF THE DRAWINGS

FIG. 8 is an end elevational view of a legway forming part of the table leg wire management apparatus depicted in FIGS. 3–5.

FIG. 9 is a side elevational view of the legway depicted in FIG. 8.

FIG. 10 is a top elevational view of the legway shown in FIG. 8 as viewed in the direction of the arrows of line 10—10.

FIG. 11 is a top elevational view of the legway shown in FIGS. 8–10 prior to insertion of the legway into the table leg configured as shown in FIG. 6.

FIG. 12 is a top elevational view of the legway after insertion into the table leg.

DESCRIPTION OF THE PREFERRED EMBODIMENTS

Figure 1:
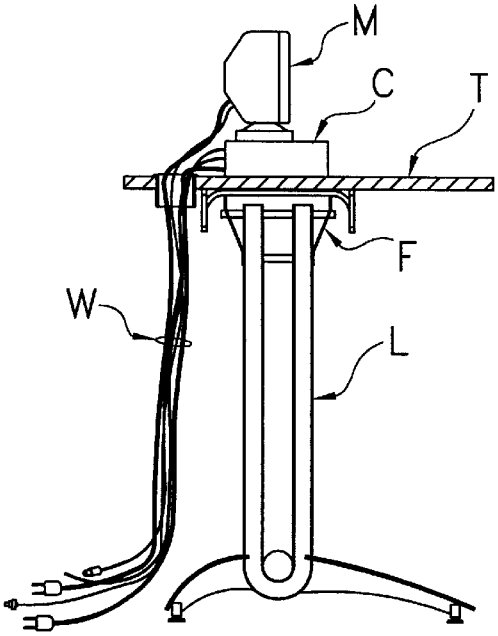
Fig. 1 (PRIOR ART)
FIG. 1 is a side elevational view of a worktable illustrating the problem of wire management addressed by the present invention.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

The present invention relates to wire management for a "electrified" furniture, or furniture on which an array of electrical equipment is supported. Furniture of this type can include conference or training tables, and the electrical equipment can include a wide array of devices, such as lights, computers, printers, typewriters, etc. An illustration of the problem is found in FIG. 1. A worktable T is supported by a leg assembly L, which in the illustrated embodiment is attached by a folding mechanism F. The table T provides a working surface for a personal computer C, a monitor M, as well as other electrical devices not depicted. The devices include a plurality of wires W that must be plugged into wall socket(s). With this conventional table arrangement, the wires W dangle precariously from the table T and are thus susceptible to becoming entangled by the work table user. Moreover, the hanging mass of wires is far from aesthetically pleasing.

Figure 2:
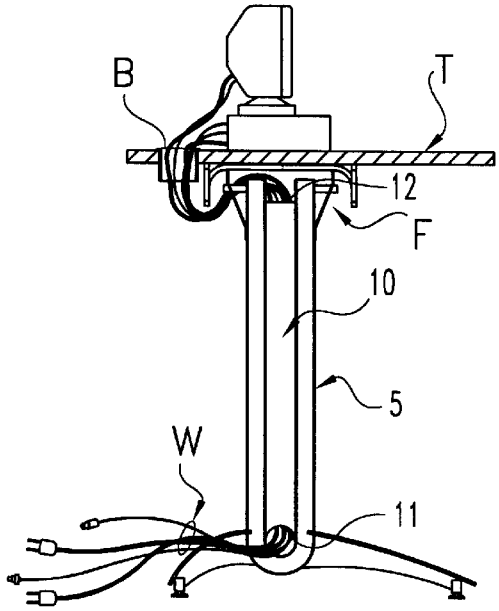
FIG. 2 is a side elevational view of an article of furniture incorporating the leg wire management apparatus according to one embodiment of the present invention.
Figure 3:
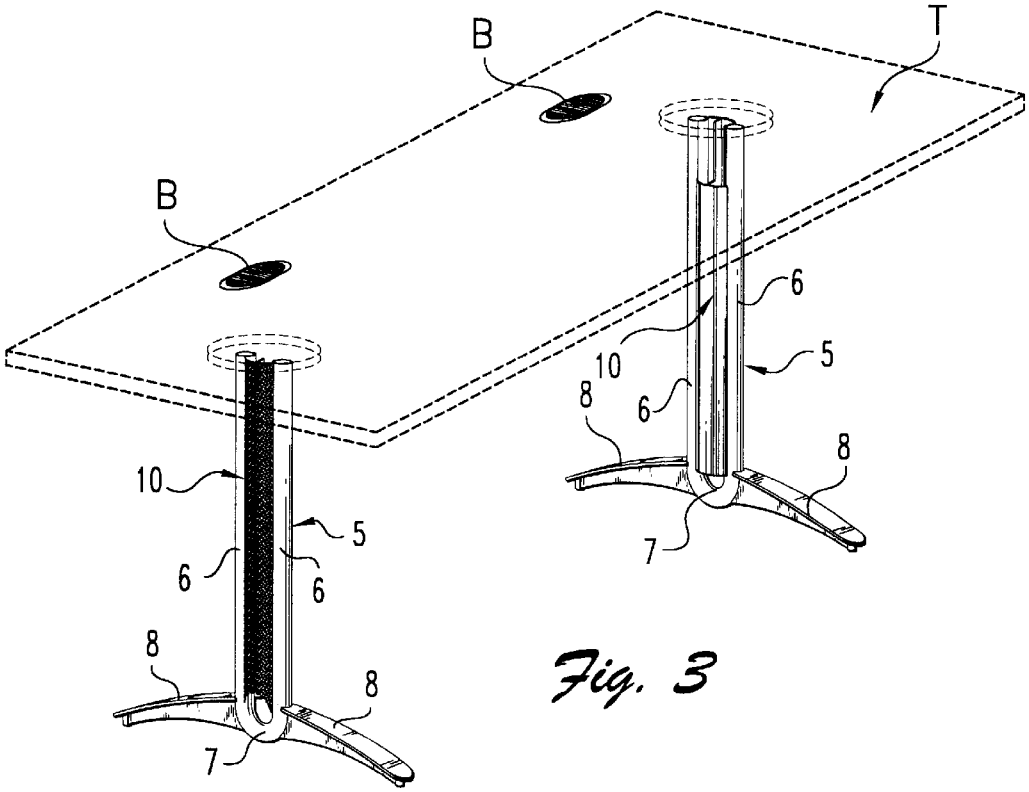
FIG. 3 is a top perspective view of a worktable utilizing two table legs incorporating the wire management apparatus of the present invention.

In accordance with the present invention a leg wire management apparatus 10 is provided that efficiently contains and conceals the cables and wires, as shown in FIGS. 2 and 3. The configuration in FIG. 2 contemplates a table leg L that can be folded using folding mechanism F underneath the table work surface. The configuration in FIG. 2 envisions that the table leg L is fixed to the work surface. The table T can include a number of brush bezels B pressed into the work surface through which the wires and cables pass to the underside of the work surface. The wire management apparatus 10 of the present invention is equally applicable to either configuration; although it can be advantageously utilized with the folding leg arrangement shown in FIG. 2.

Figure 4:
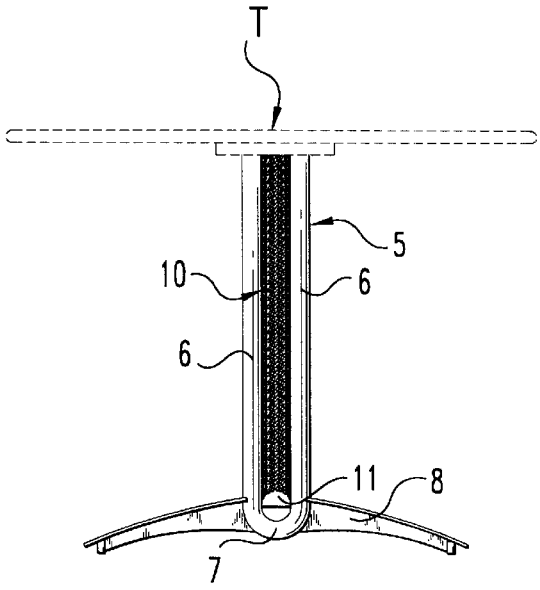
FIG. 4 is an end elevational view of a table leg utilizing the wire management apparatus of the worktable depicted in FIG. 3.
Figure 5:
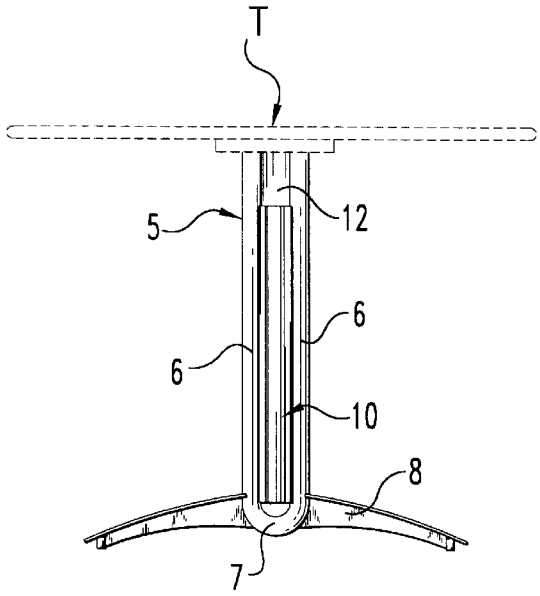
FIG. 5 is an opposite end elevation view of the table leg and wire management apparatus shown in FIG. 4.
Figure 6:
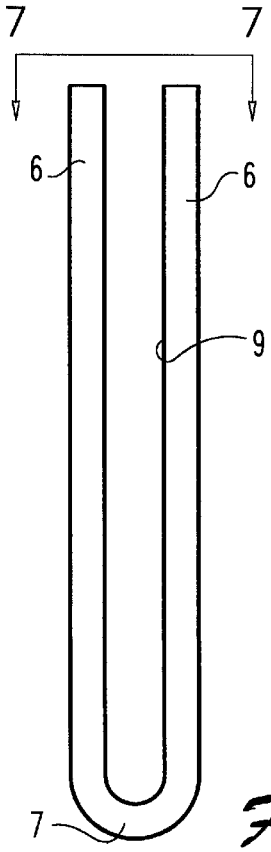
FIG. 6 is an end elevational detail view of table leg shown in FIGS. 2–5.
Figure 7:
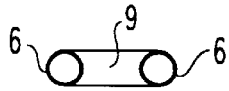
FIG. 7 is a top elevational view of the table leg detail in FIG. 6 as viewed in the direction of the arrows of line 7—7.

Referring to FIGS. 3–5, the table T is supported by two legs 5, each carrying a wire management apparatus 10. Each of the legs 5 is formed by a pair of leg posts 6. As shown in FIGS. 6–7, the leg posts 6 are connected at a bend 7 to the feet 8. The leg posts 6 are separated to define a gap or channel 9. The wire management apparatus 10 is disposed within that gap 9. As seen in FIG. 4, the wire management apparatus 10 forms an exit opening 11 at the bottom of the leg 5 adjacent the bend 7. At the other end of the leg 5, the wire management apparatus 10 defines an entry opening 12, as shown in FIG. 5. As depicted in FIG. 2, the various wires and cables are fed through entry opening 12 into the wire management apparatus 10 and exit the apparatus at opening 11 at the bottom of leg 5. The wires and cables are very effectively managed in a visually appealing manner. Moreover, with the wires exiting the apparatus 10 at the feet 8 of the leg, it is easier and less obtrusive to carry the wires to the wall outlets.

A central component of the wire management apparatus 10 of the present invention is the legway 15 illustrated in FIGS. 8–10. The legway 15 constitutes an elongated tubular body 17 that is sized to reside within the gap 9 between the leg Posts 6, as described above. The tubular body 17 defines a semi-circular cutout 18 at the bottom end 19 that establishes the exit opening 11 depicted in FIG. 4. The body also defines a notch 21 adjacent the top end 22 of the legway 15, which corresponds to the entry opening 12 shown in FIG. 5. Preferably, the notch 21 is formed by removing an approximately 180° segment from the tubular body 17. The notch 21 extends below the top end 22 a sufficient distance to allow several wires and cables to be navigated into the legway 15.

The transverse cross-section of the tubular body 17 can be best seen in FIG.10. The body 17 includes a forward portion 25 that is preferably arranged to face outward from the leg 5 relative to the table T. The body also includes opposite clamping arms 27 integrally formed with the forward portion 25. The clamping arms define a leg recess 28 that is arcuate in shape to receive a corresponding one of the leg posts 6. Most preferably, the leg recesses 28 are formed at a circular radius corresponding to the radius of the leg posts. The leg recesses 28 are limited to an arc segment of the circumference of the leg posts 6 that is sufficient to retain the leg posts within the recesses when the legway 15 is situated within the gap 9.

The clamping arms 27 are configured to provide an outward force to clamp the legway within the gap 9 between the leg posts 6. This clamping feature can be understood by reference to FIGS. 11 and 12. As shown in FIG. 11, the tubular body 17 is formed to have a natural or unstressed configuration in which the clamping arms 27 splay outward at an angle A relative to a centerline passing through the body. In other words, the tubular body 17 is initially formed with the clamping arms 27 at the described angle. The legway 15 is placed within the gap 9 by pushing the tubular body 17 between the leg posts 6. Each clamping arm 27 defines a guide surface 29 that bears against a corresponding leg post as the body is pushed into the gap. The clamping arms are deflected inward toward each other in the direction of the arrows D until the tubular body 17 is situated entirely between the leg posts 6, as shown in FIG. 12. In this position, each leg post 6 is firmly disposed within a leg recess 28 of a corresponding clamping arm 27. The tubular body can be readily removed from between the leg posts by pushing in the opposite direction.

With this feature, the legway 15 of the present invention can be readily added or removed to an existing furniture leg having more than one leg post. The legway can be disposed between any adjacent pair of leg posts forming a furniture leg structure. in some circumstances, it may be desirable to remove the legway entirely, leaving the basic leg 5. The resiliently deflectable clamping arms 27 provide this capability.

As can be seen in FIG. 12, the tubular body 17 defines an outer envelope that is substantially contained within the space defined by the gap 9 between the leg posts 6. Alternatively, the tubular body can be truncated or flattened at its forward portion 25, and opposite the portion 25, so that the legway is entirely disposed within the envelope formed by the leg 5. One advantage presented by the legway 15 of the illustrated embodiment is that the tubular body 17 will not interfere with the normal operation of a folding leg. Since the legway is contained within the gap 9 of the leg 5 it is kept out of the way of the folding mechanism, such as mechanism F shown in FIG. 2.

Returning to FIG. 10, the tubular body preferably includes a central rib 30 that projects to the interior of the legway 15 from the forward portion 25. The rib 30 traverses substantially the entire length of the tubular body 17, terminating at the circular cutout 18, as illustrated in FIG. 8. The central rib 30 divides the interior of the tubular body 17 into two wire/cable channels 33, 34. The two A channels 33, 34 provide a more organized approach to restraining the loose wires land cables, optimally preventing entanglement of the wires/cables.

In a further feature of one embodiment of the invention, the central rib 30 includes a rear flange 31 opposite the forward portion 25. The rear flange 31 follows the outer contour of the legway 15 defined by the guide surfaces 29 of the two clamping arms 27. Like the central rib 30, the rear flange 31 extends along substantially the entire length of the legway 15. The central rib 30 and rear flange 31 provide mechanical stiffness to the elongated legway 15 so that the tubular body 17 will not be distorted or bent when it is pushed into the gap 9 between the leg posts 6. In addition, the rear flanges cooperate With the clamping arms 27 to define a pair of entry slots 35, 36. The entry slots 35, 36 open into a corresponding wire channel 33, 34. In the preferred embodiment, the entry slots 35, 36 are sufficiently wide to allow passage of an electrical cable, cord or wire.

With this feature, it is not necessary to snake the plug end of a wire or cable through the top end 22 of the legway 15 and to blindly navigate the wire,cable through the legway so that the plug end exits from the exit opening 11 at the bottom of the leg 5. Instead, the wire or cable can be fed through one of the slots 35, 36 into one of the channels 33, 34. The plug end of the wire/cable can then be easily passed through the exit opening 11. Preferably, the slots 35, 36 are wide enough to receive the wires/cables even when the legway is its operative position shown in FIG. 12. Alternatively, the wires and cables can be fed into the legway 15 before it is positioned between the leg posts, although this approach may be more cumbersome.

Figure 13:
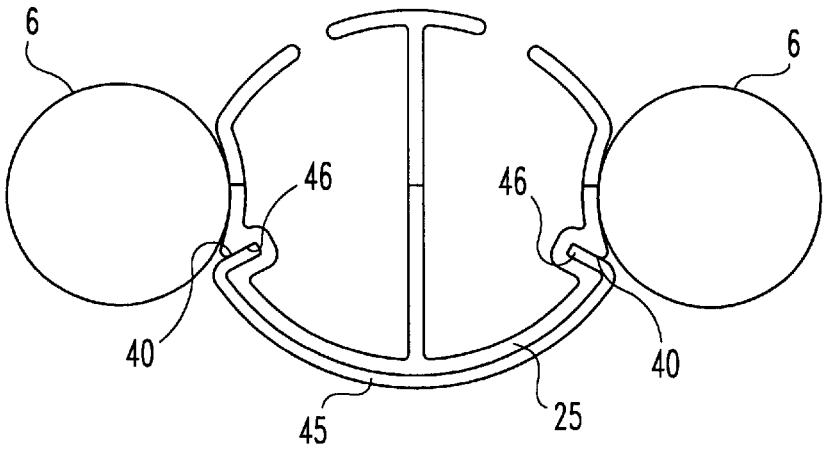
FIG. 13 is a top elevational view of the legway shown in FIGS. 8–12 with a decorative cover plate according to one aspect of the present invention.

In a further embodiment of the invention, the wire management apparatus 10 of the present invention contemplates means for providing a decorative or ornamental appearance. To achieve this benefit, the invention contemplates a cover plate 45 that is mounted to the legway 15, as shown in FIG. 13. The cover plate 45 is preferably in the form of a sheet of aesthetically pleasing material bent into an arc segment to correspond to the forward portion 25 of the tubular body 17. The cover plate 45 forms elongated tangs 46 at the free edges of the plate. The tangs are configured to be pressed into correspondingly sized slots 40 formed in the tubular body, as depicted in FIGS. 10 and 13. Preferably, the tangs are held in place by friction and the natural springiness of the cover plate material. In addition, once the legway 15 is in its operative position, the leg posts 6 will also help retain the tangs 46 within the slots 40. Alternatively, a form of press-fit engagement can be achieved between the cover plate and tubular body.

Figure 14:
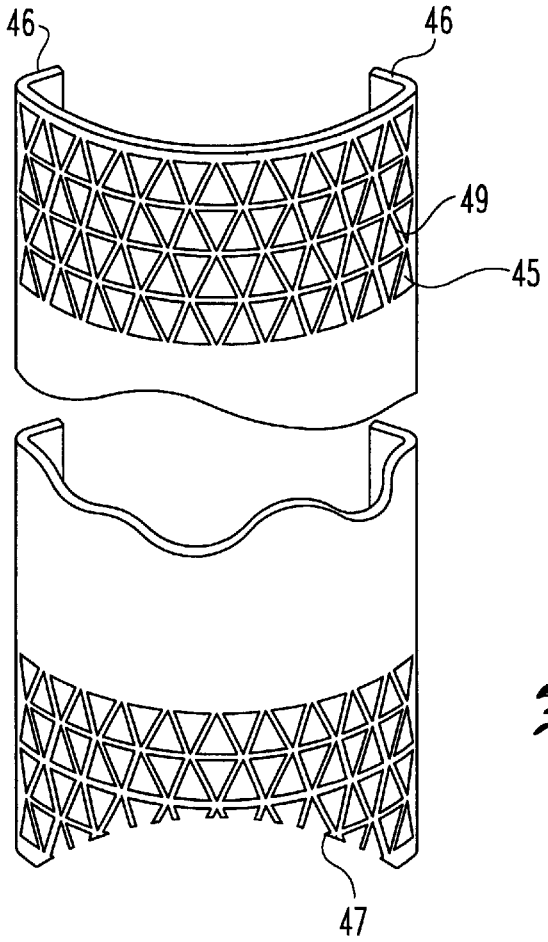
FIG. 14 is an end perspective view of the decorative cover plate depicted in FIG. 13.

The cover plate 45 defines a circular cutout 47 at its lower edge to correspond to the cutout 18 at the bottom of the legway tubular body 17. While the cover plate 45 can be a solid sheet of material, it is envisioned that the plate carry a decorative feature, such as feature 49 shown in FIG. 14. In one embodiment, the decorative feature 49 can be a mesh configuration, although other aesthetically pleasing designs are contemplated.

The cover plate 45 is preferably readily removable from the legway 15. In this sway, different plates 45 can be provided for use with a single legway configuration. The cover plate can be color coordinated to match the office furniture, or provided with features to match the office decor. With the addition of the cover plate 45, the legway tubular body 17 can essentially have any appearance. Alternatively, where the decorative feature 49 is a mesh configuration, the tubular body 17 can have a complementary exterior color or configuration.

In a specific embodiment of the invention, the tubular body 17 of the legway 15 is formed of a resilient high-density thermoplastic, a metal such as stainless steel, or other comparable material. The body material must exhibit sufficient resilience so that the clamping arms 27 can be repeatedly flexed without diminishing their outward clamping force. The legway of the present invention is particularly well suited to formation in an extrusion process. During the extrusion process, the clamping arms 27 are situated at the angle A depicted in FIG. 11. The decorative cover plate 45 can also be formed of a plastic or a metal, such as stainless steel.

Again, in the specific embodiment, the tubular body has a width of 2.5 inches to accommodate a similarly dimension gap 9 between the leg posts 6. The circular cutout 18 at the bottom of the body is formed at a radius of about 1.0 inch, while the notch 21 extends about 3.625 inches from the top end 22 of the body 17. In this embodiment, the legway defines an entry slot 35 having a width of about 0.15 inches, while the opposite entry slot 36 is wider, at 0.28 inches. With this configuration, the narrower entry slot 35 can be reserved for narrower electrical cords and phone/data cables, while the larger slot 36 can accommodate larger cables, such as a printer cable.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A wire management apparatus for an article of furniture comprising:

a leg connectable to the article of furniture and configured to support the article of furniture, said leg including at least two elongated leg posts defining a gap having a width therebetween; and a legway removably disposed within said gap, said legway including an elongated tubular body defining a channel for receiving wires and/or cables therethrough, said tubular body having a pair of opposite elongated clamping arms configured to receive a portion of a corresponding leg post therein, said clamping arms having an unstressed configuration that exceeds said width of said gap and including means for resiliently deflecting said clamping arms toward each other to a position in which said clamping arms are disposed within said gap.

2. The assembly of claim 1, wherein said tubular body of said legway has a top end and an opposite bottom end, said top end arranged adjacent the article of furniture when the leg is connected to the article of furniture and said legway is disposed within said gap, said body defining a cutout at said bottom end sized to receive the wires and/or cables passing therethrough.

3. The assembly of claim 1, further comprising a cover plate and means for mounting said cover plate over a portion of said legway between said leg posts.

4. The assembly of claim 3, wherein said cover plate includes a decorative pattern.

5. The assembly of claim 4, wherein said decorative pattern is a mesh.

6. The assembly of claim 3, wherein said means for mounting includes tangs at opposite ends of said cover plate and a pair of slots defined in said tubular body configured to receive a corresponding tang therein.

7. A wire management apparatus for use with a furniture leg supporting an article of furniture and having a pair of leg posts defining a gap therebetween, comprising:

an elongated tubular body sized for extending along substantially the entire length of the said tubular body having a pair of opposite elongated clamping arms configured for receiving a portion of a corresponding leg post therein, said clamping arms having an unstressed configuration that exceeds the width of the gap between the leg posts; and means for resiliently deflecting said clamping arms toward each other to a position in which said claiming arms are disposable within the gap.

8. The wire management apparatus of claim 7, wherein said tubular body has a top end and an opposite bottom end, said top end arranged adjacent the article of furniture when said body is disposed within the gap, said body defining a cutout at said bottom end sized to receive the wires and/or cables passing therethrough.

9. The wire management apparatus of claim 7, further comprising a cover plate and means for mounting said cover plate over a portion of said tubular body when said tubular body is disposed between the leg posts.

10. The wire management apparatus of claim 9, wherein said cover plate includes a decorative pattern.

11. The wire management apparatus of claim 10, wherein said decorative pattern is a mesh.

12. A wire management apparatus for use with a furniture leg supporting an article of furniture and having a pair of leg posts defining a gap therebetween, comprising:

an elongated body sized for extending along substantially the entire length of the furniture leg, said body defining a channel for receiving wires and/or cables therethrough;

said body having a pair of opposite elongated clamping arms configured for receiving a portion of a corresponding leg post therein, said clamping arms having an unstressed configuration that exceeds the width of the gap between the leg posts and said arms resiliently deflectable toward each other to a position in which said clamping arms are disposable within the gap.

13. The wire management apparatus of claim 12, wherein said body of said legway has a top end and an opposite bottom end, said top end arranged adjacent the article of furniture when the leg is connected to the article of furniture and said body is disposed within said gap, said body defining a cutout at said bottom end sized to receive the wires and/or cables passing therethrough.

14. The wire management apparatus of claim 13 wherein said body defines a notch extending from said top end, said notch sized to receive the wires and/or cables therethrough.

15. The wire management apparatus of claim 12 wherein said body defines at least one slot extending along the length of said body between said clamping arms, said slot being sized to receive the wires and/or cables therethrough for introduction into said channel of said body.

16. A The wire management apparatus of claim 15, further comprising a central rib disposed between said clamping arms within said body and dividing said channel into two channels for passage of the wires and/or cables.

17. The wire management apparatus of claim 16, further comprising a rear flange extending from said central rib, said central rib cooperating with one of said clamping arms to define said slot extending along the length of said body, said central rib cooperating with the other of said clamping arms to define a second slot extending along the length of said body, each of said slots sized to receive the wires and/or cables therethrough for introduction into a corresponding one of said two channels.

18. The wire management apparatus of claim 12:

wherein said body further includes a forward portion defined between said clamping arms; and further comprising an elongated cover plate engagable to said forward portion, said cover plate shaped and sized to correspond to said forward portion.

19. The wire management apparatus of claim 18 further comprising a tang projecting from said cover plate, said tang configured to engage a slot fined in said body.

20. The wire management apparatus of claim 18, wherein said cover plate includes a decorative pattern.

21. Gel The wire management apparatus of claim 20, wherein said decorative pattern is a mesh.

* * * * *